US005094019A

United States Patent [19]

DeVincenzo

[11] Patent Number: 5,094,019

[45] Date of Patent: Mar. 10, 1992

[54] VEHICLE POSITIONING METHOD FOR MOUNTING PLOWS, TRAILERS AND THE LIKE

[75] Inventor: Paul DeVincenzo, 35 Spaulding St., Everett, Mass. 02149

[73] Assignee: Paul DeVincenzo, Everett, Mass.

[21] Appl. No.: 588,450

[22] Filed: Sep. 26, 1990

[51] Int. Cl.[5] ..... E01H 5/00

[52] U.S. Cl. ..... 37/197; 37/231; 172/273; 188/32; 414/401; 238/10 R

[58] Field of Search ..... 188/32; 414/396, 401, 414/585; 104/44; 37/197, 231; 172/273; 238/10 R

[56] References Cited

U.S. PATENT DOCUMENTS

| | | | |
|---|---|---|---|
| 1,408,379 | 2/1922 | Moore | 188/32 X |
| 3,084,953 | 4/1963 | McGregor | 238/10 R |
| 3,255,711 | 6/1966 | Kiraly | 104/44 |
| 3,760,516 | 9/1973 | Billingsley | 37/231 |
| 4,039,075 | 8/1977 | Gray | 104/162 X |
| 4,528,711 | 7/1985 | Packer | 238/10 R X |
| 4,726,516 | 2/1988 | Cree | 238/10 R |
| 4,776,115 | 10/1988 | Nicodemus et al. | 37/231 |
| 4,873,775 | 10/1989 | Richey | 37/231 |

FOREIGN PATENT DOCUMENTS

| | | | |
|---|---|---|---|
| 2611682 | 9/1988 | France | 414/401 |

*Primary Examiner*—Randolph A. Reese
*Assistant Examiner*—Arlen L. Olsen
*Attorney, Agent, or Firm*—Fish & Richardson

[57] ABSTRACT

An apparatus for positioning a vehicle relative to an implement to be mounted upon the vehicle consists of a stop member defining a stop surface for engagement by tread surfaces of the vehicle to be positioned, and guide arms adjustably mounted upon the stop member and defining arcuate guide surfaces for engagement by the side surfaces of the vehicle wheels. A method for positioning a vehicle relative to an implement to be mounted thereupon is also described.

5 Claims, 3 Drawing Sheets

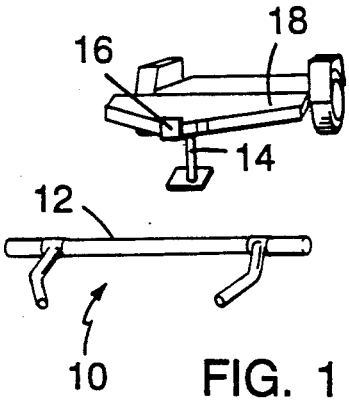
FIG. 1
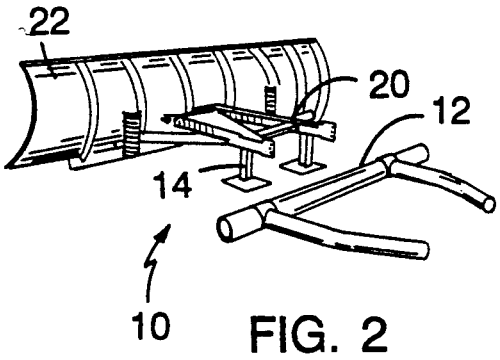
FIG. 2
FIG. 3
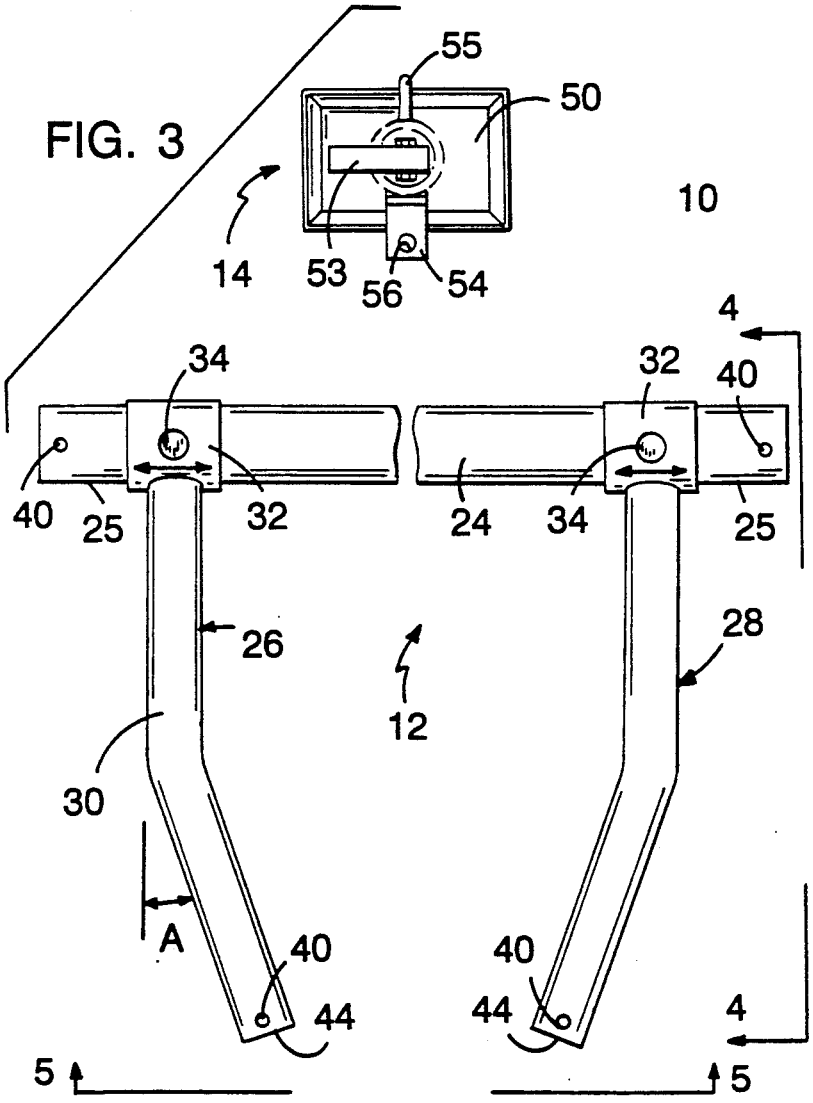
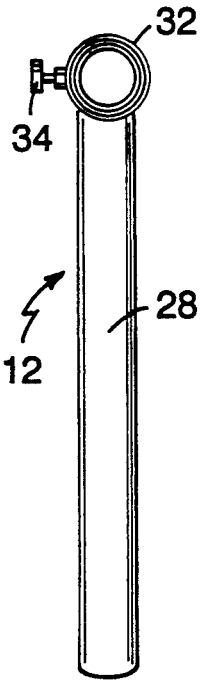
FIG. 4

VEHICLE POSITIONING METHOD FOR MOUNTING PLOWS, TRAILERS AND THE LIKE

The invention relates to an apparatus for the positioning of a vehicle relative to an implement such as a snow plow, trailer hitch or like to be mounted thereupon.

Vehicle implements such as snow plows and trailers may typically be used intermittently as the need arises. Between periods of use, the plow or trailer hitch is disengaged from the vehicle and left in storage, typically with the tongue or mounting arm resting upon a jack stand or the like. When it is desired to use the plow, trailer or similar implement again, the vehicle must be brought back into a proper position relative to the implement. In many instances, the plow or trailer is too heavy to be moved, so the vehicle must be repositioned precisely. This repositioning process often results in an extended period of trial and error, particularly in circumstances where the vehicle driver is working alone, or is inexperienced, as he or she must repeatedly leave the vehicle to check the position of the vehicle mounting apparatus relative to the implement, return to the vehicle to adjust its position, leave the vehicle to check the result of the adjustment, then reenter the vehicle to adjust its position further. This process may be repeated through a number of cycles, and often may be aided only to a small degree when a second person is present to provide directions.

Others, e.g. St. Pierre U.S. Pat. No. 3,851,894 and Haug U.S. Pat. No. 4,509,768, have thought to improve this process by providing mounting assemblies which accomplish mating even if there is some slight misalignment of the vehicle.

SUMMARY OF THE INVENTION

According to one aspect of the invention, an apparatus for positioning a vehicle relative to an implement to be mounted upon the vehicle comprises a stop member defining a stop surface for engagement by tread surfaces of a vehicle to be positioned, and guide arm members adjustably mounted upon the stop member and defining arcuate guide surfaces for engagement by the side surfaces of the wheels of the vehicle to be positioned.

Preferred embodiments of this aspect of the invention may include one or more of the following features. The stop member defines a stop surface for engagement by at least two wheels of a vehicle to be positioned. The apparatus further comprises means for attachment of the guide arm members upon the stop member in sliding engagement, preferably it also comprises means for fixing the position of the guide arm members relative to the stop member. The apparatus further comprises a stand for vertical support of a mounting member of an implement to be mounted upon a vehicle, the stand having a base and a generally vertical support shaft. The apparatus further comprises means for securing the stop member to an underlying surface, and preferably comprises means for securing the guide arm members to an underlying surface.

According to another aspect of the invention, an apparatus for positioning a vehicle relative to an implement to be mounted upon the vehicle comprises an elongated stop member defining a stop surface for engagement by tread surfaces of wheels of a vehicle to be positioned, guide arm members adjustably mounted upon the stop member, the guide arm members comprising sleeve elements mounted for sliding adjustment along the elongated stop member, means for fixing the guide arm members relative to the stop member, and guide arm elements defining arcuate guide surfaces for engagement by side surfaces of wheels of a vehicle to be positioned, and means for securing the apparatus to an underlying surface.

In preferred embodiments of this aspect of the invention, the apparatus further comprises a stand for vertical support of a mounting member of an implement to be mounted upon a vehicle, the stand having a base and a generally vertical support shaft.

According to another aspect of the invention, a method for positioning a vehicle relative to an implement to be mounted thereupon comprises positioning a vehicle with an implemented mounted thereupon at a desired location, providing an apparatus comprising a stop member defining a stop surface for engagement by tread surfaces of a vehicle to be positioned, and guide arm members defining arcuate guide surfaces for engagement by the side surfaces of the wheels of the vehicle to be positioned, positioning the stop member with the stop surface in engagement with treads of wheels of the vehicle, adjusting the positions of the guide arm members relative to the stop member in a manner to engage the arcuate guide surfaces with the side surfaces of the wheels of the vehicle, securing the positions of the arms relative to the stop member and securing the position of the apparatus, removing the implement from the vehicle and removing the vehicle, for remounting the implement, advancing the vehicle toward the stop member, while allowing the side surfaces of the wheels to engage and be guided by the guide surfaces of the guide arm members, advancing the vehicle to also engage the wheel treads upon the stop surface, and mounting the implement upon the vehicle.

Preferred embodiments of this aspect of the invention may include one or more of the following features. The guide arm members are adjustably mounted upon the stop member, and the method comprises adjusting the position of the guide arm members along the stop member to engage the arcuate guide surfaces with the side surfaces of the wheels of the vehicle. The method comprises the further steps of providing a stand for vertical support and positioning of an implement mounting arm, and positioning the stand relative to the stop member for receiving and supporting the mounting arm thereupon. The method comprises advancing a vehicle to engage its front wheels upon the vehicle positioning apparatus for mounting a plow or the like at the front of a vehicle. The method also comprises advancing a vehicle to engage its rear wheels upon the vehicle positioning apparatus for mounting a trailer or the like at the rear of a vehicle.

These and other features and advantages of the invention will be seen from the following description of a presently preferred embodiment, and from the claims.

DESCRIPTION OF PRESENTLY PREFERRED EMBODIMENT

We first briefly describe the drawings.

BRIEF DESCRIPTION OF THE DRAWINGS

FIGS. 1 and 2 are perspective views of a vehicle positioning apparatus of the invention with implements, here a trailer hitch (FIG. 1) and a snow plow (FIG. 2) disposed in position for mounting;

FIG. 3 is a plan view of the vehicle positioning apparatus of FIGS. 1 and 2;

FIG. 4 is a side elevation view of the vehicle positioning device of the apparatus of the invention taken at the line 4—4 of FIG. 3;

FIG. 8 is a somewhat diagrammatic view of a vehicle approaching a positioning apparatus of the invention for mounting of an implement thereupon, while

DESCRIPTION OF PREFERRED EMBODIMENTS

Figure 5:
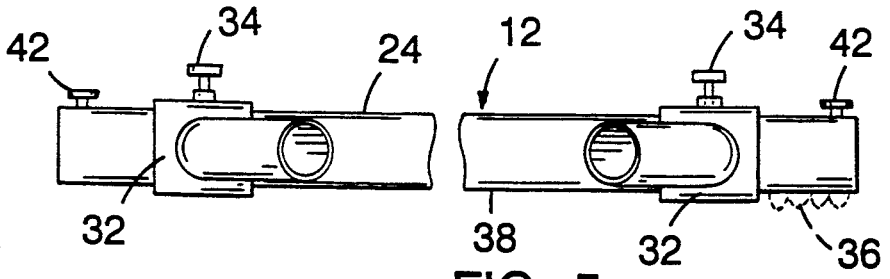
FIG. 5 is a front elevation view of the vehicle positioning device of the apparatus of the invention taken at the line 5—5 of FIG. 3.

Referring to the figures, a vehicle positioning apparatus 10 of the invention includes a vehicle positioning device 12 and stand 14 for supporting the tongue or mounting arm of an implement to be mounted upon a vehicle. Referring to FIG. 1, an apparatus 10 is disposed for positioning the rear end of a vehicle relative to the tongue 16 of a trailer 18. Referring to FIG. 2, an apparatus 10 is disposed for positioning the front end of a vehicle relative to the mounting arm 20 of a snow plow 22.

Referring now to FIG. 3, the vehicle positioning device 12 of the apparatus 10 of the invention consists of an elongated stop member 24, e.g. formed of a 4-inch diameter pipe about 8 feet in length, upon which are slidingly mounted a pair of arcuate wheel guide arms 26, 28. Each of the wheel guides consists of a guide arm 30, e.g. formed of a 3-inch diameter pipe about 36 inches in length, bent at its midpoint to an angle, A, e.g. about 45°. Each guide arm 30 is attached to a sleeve 32 mounted slidingly upon the stop member 24, with a lock member 34 extending in threaded engagement through the sleeve to bear upon the outer surface of the stop member. Referring also to FIGS. 4 and 5, the vehicle positioning device 12 may be secured against movement by fastener spikes 42 extending into the ground through apertures 40 provided adjacent the ends of the stop member 24 and adjacent the free end 44 of each of the guide arms 30, and also by toothed grip elements 36 (suggested by dashed lines in FIG. 5) mounted upon the undersurface 38 of the stop member 24.

Figure 6:
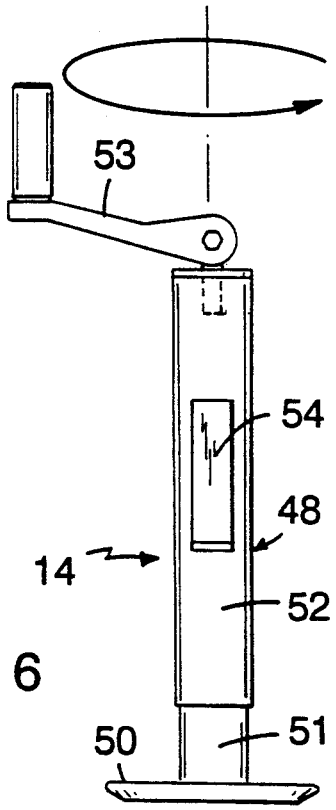
FIGS. 6 and 7 are front and side views respectively of one embodiment of an adjustable support device of the apparatus of the invention for adjustably supporting the tongue or mounting arm of an implement.
Figure 7:
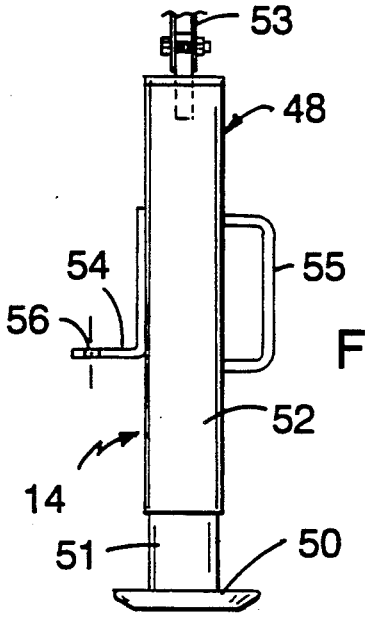

The vehicle positioning apparatus 10 further includes a vertically adjustable stand 14, e.g. 2,000 pound capacity as provided by Fulton Manufacturing Corp. of Milwaukee, Wis., for supporting the tongue or mounting arm of the implement to be mounted on the vehicle at the desired height. Referring now to FIGS. 6 and 7, in one embodiment, the stand 14 has a vertical body 48 disposed upon a base 50 having an undersurface of significant area to prevent it from sinking into the ground under the weight of the tongue or arm, e.g. when the implement is stored for an extended period on wet or soft ground. The body 48 consists of inner and outer telescoping sleeves 51, 52. A rotatable handle 53 is attached to a threaded rod mounted within the body 48 for vertical adjustment of the outer sleeve 52 relative to the inner sleeve 51 to accommodate a range of positions for the tongue or arm. Vertical support member 54 is mounted on sleeve 52 for engagement, e.g., by the arms of a snow plow 22, and defines an aperture 56 for securement of the plow or trailer tongue to the support member. A handle 55 is provided for steadying the support device 14 during positioning.

Figure 8:
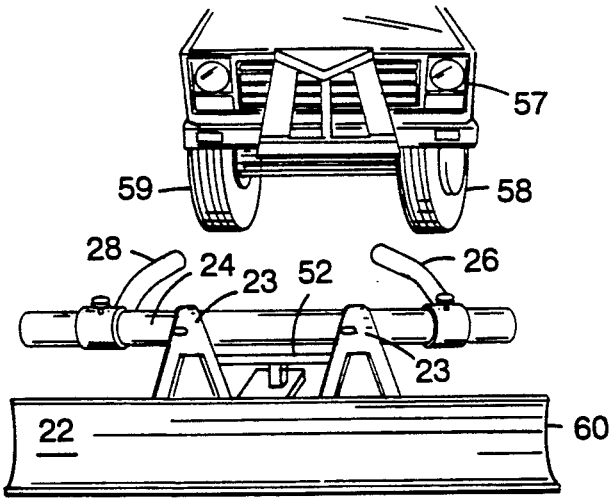
Figure 12:
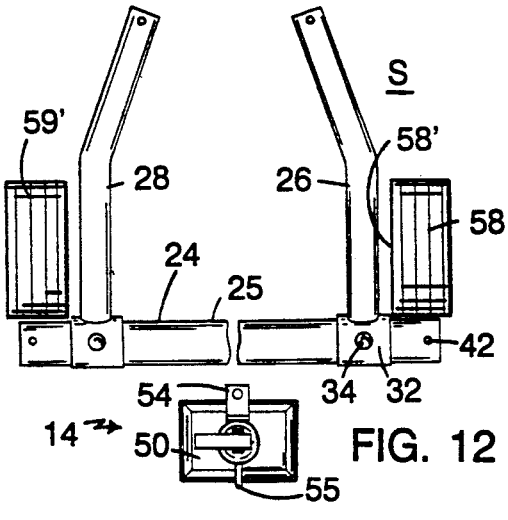

Referring to FIG. 8 (and also to FIG. 12), a vehicle 57 with a snow plow 22 mounted thereupon may be positioned in a region where it is desired to remove and store the plow during periods of non-use. The vehicle positioning apparatus 10 of the invention is positioned with the surface 25 of stop member 24 resting against the front wheels 58, 59 of the vehicle (toothed grip elements 36 affixed to the under surface 38 of stop member 24 aid in keeping the positioning device 12 in place, and also provide clearance between the device 12 and the underlying surface S for movement of the guide member sleeves 32). The wheel guide arms 26, 28 are adjusted by sliding movement of the sleeves 32 along member 24 until the guide arms 26, 28 engage the inner surfaces 58′, 59′ of the respective front wheels 58, 59 of the vehicle 57. The wheel guides 26, 28 are fixed in position relative to the stop member 24 by tightening of the threaded lock members 34 in sleeves 32 to engage stop member 24. The apparatus is further secured to the underlying surface S by means of spikes or the like 42 inserted through the apertures 40 provided at the ends of the stop member and guide arms. The stand 14 is then positioned with the support member 54 disposed beneath the mounting arms 23 of the snow plow 22. The plow blade 60 is then lowered and secured to the stand 14, e.g. by a bolting through aperture 56, the plow 22 is removed from the vehicle and the vehicle may be moved away.

Figure 9:
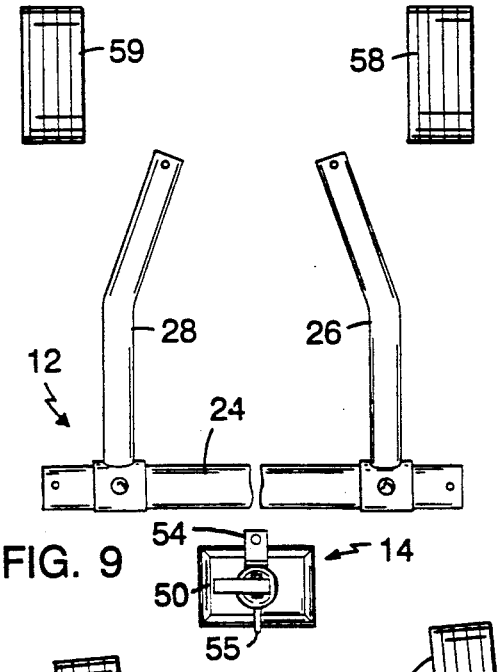
FIGS. 9, 10, 11 and 12 are diagrammatic plan views of the vehicle positioning process.
Figure 11:
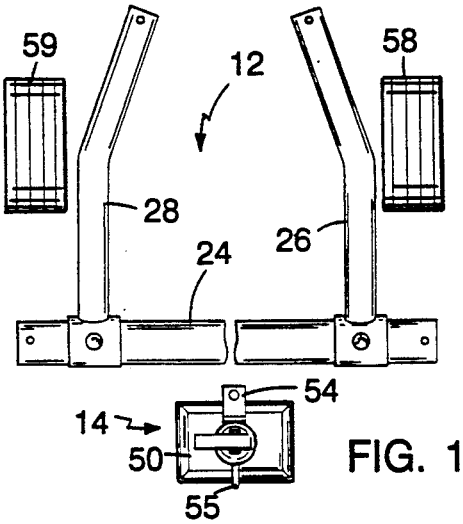
Figure 10:
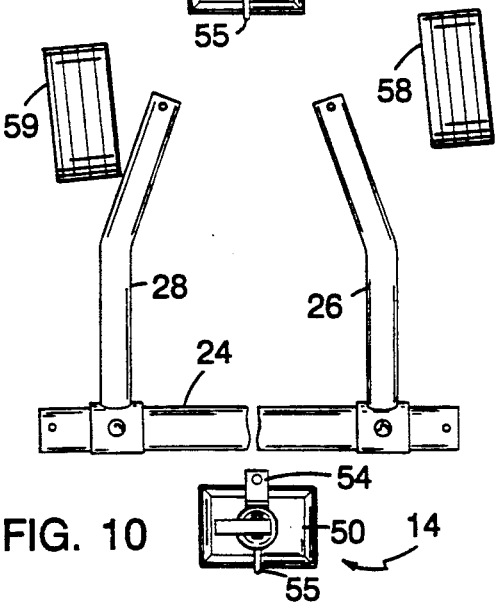

When it is desired to remount the plow 22, the driver may simply move his vehicle 57 back into the same prescribed position relative to the plow by using the surfaces of the guide arms 26, 28 and stop member 24 as aids to positioning. Referring to FIG. 8 and also to FIG. 9, the driver positions his vehicle 57 in front of a plow 22 to be mounted upon the vehicle. Referring to FIG. 10, the driver advances the vehicle 57 until the wheels 58, 59 first engage upon the inner surfaces of the guide arms 26, 28. The driver then continues to advance the vehicle, using the guide arms to position the vehicle (FIG. 11) relative to the implement to be mounted until the wheel tread surfaces engage upon the surface of the stop member 24 (FIG. 12), indicating that the vehicle is positioned properly for remounting the implement, i.e. the snow plow 22. In this manner, the vehicle may be placed back into the position required for remounting the plow without need for a second person to direct the driver or need for the driver to leave and reenter the vehicle cab repeatedly to adjust the position of the vehicle, and also without need for strenuous exertion as required to attempt to reposition the plow.

The apparatus may also be employed for positioning a vehicle with respect to other devices to be removed or mounted upon the vehicle. For example, referring again to FIG. 1, the apparatus of the invention may be used to position the rear wheels of a vehicle relative to a trailer tongue 16 or the like at a storage location or at a site in the field.

Figure 13:
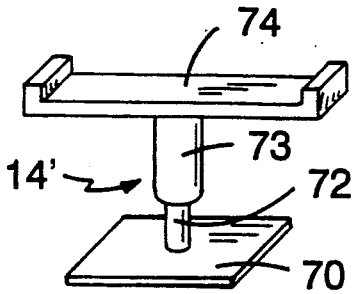
FIG. 13 is a somewhat diagrammatic perspective view.
Figure 14:
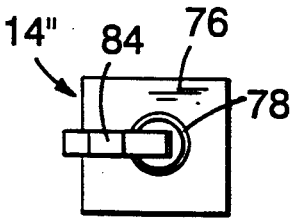
FIGS. 14 and 15 are front elevation and top plan views, respectively, of alternate embodiments of an adjustable support device of the apparatus of the invention.
Figure 15:
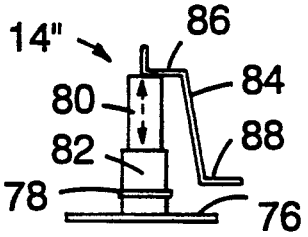

Other embodiments are within the following claims. For example, support stands of other suitable construction, such as the stand 14′ shown in FIG. 13 and stand 14″ shown in FIGS. 14 and 15, may also be employed according to the invention. The stand 14' has a base 70, inner and outer sleeves 72, 73 and a mounting arm 74 of extended length, e.g. for engaging the mounting arms of a plow. Stand 14" has a base 76 and coaxial inner and outer sleeves 80, 82. The inner sleeve 80 is vertically adjustable relative to sleeve 82, and is fixed in position by means of threaded lock member 76. (In a preferred embodiment, the stand may further comprise a spring disposed within the outer sleeve in a manner to urge the inner sleeve upwards.) A rest member 84, mounted upon the inner sleeve, defines first and second plow rest surfaces 86, 88 disposed for receiving plows of different manufacture thereupon.

What is claimed is:

1. A method for positioning a vehicle relative to an implement to be mounted thereupon, comprising:

positioning a vehicle with an implement mounted thereupon at a desired location, providing an apparatus comprising a stop member defining a stop surface for engagement by tread surfaces of a vehicle to be positioned, and guide arm members defining arcuate guide surface for engagement by the side surfaces of the wheels of the vehicle to be positioned, positioning the stop member with the stop surface in engagement with treads of wheels of the vehicle, adjusting the positions of the guide arm members relative to the stop member in a manner to engage the arcuate guide surfaces with the side surfaces of the wheels of the vehicle;

securing the positions of the arms relative to the stop member and securing the position of the apparatus, removing the implement from the vehicle and moving the vehicle away from the desired location, for remounting the implement, advancing the vehicle toward the stop member, while allowing the side surfaces of the wheels to engage and be guided by the guide surfaces of the guide arm members, advancing the vehicle to also engage the wheel treads upon the stop surface, and mounting the implement upon the vehicle.

2. The method of claim 1 wherein the guide arm members are adjustably mounted upon said stop member, and said method comprises adjusting the position of said guide arm members along said stop member to engage the arcuate guide surfaces with the side surfaces of the wheels of the vehicle.

3. The method of claim 1 comprising the further steps of:

providing a stand for vertical support and positioning of an implement mounting arm, and positioning the stand relative to the stop member for receiving and supporting the mounting arm thereupon.

4. The method of claim 1 comprising advancing a vehicle to engage its front wheels upon the vehicle positioning apparatus for mounting a plow or the like at the front of a vehicle.

5. The method of claim 1 comprising advancing a vehicle to engage its rear wheels upon the vehicle positioning apparatus for mounting a trailer or the like at the rear of a vehicle.

* * * * *